US012808135B2

(12) United States Patent
Xu et al.

(10) Patent No.: US 12,808,135 B2
(45) Date of Patent: Nov. 24, 2026

(54) BRIDGE EXPANSION AND CONTRACTION DEVICE AND INSTALLATION METHOD THEREFOR

(71) Applicant: Ningbo Roaby Technology Industrial Group Co., Ltd., Ningbo (CN)

(72) Inventors: Su Xu, Ningbo (CN); Bin Xu, Ningbo (CN); Qi You, Ningbo (CN); Zhengwu Liu, Ningbo (CN); Xueliang Hong, Ningbo (CN)

(73) Assignee: Ningbo Roaby Technology Industrial Group Co., Ltd., Ningbo (CN)

( * ) Notice: Subject to any disclaimer, the term of this patent is extended or adjusted under 35 U.S.C. 154(b) by 292 days.

(21) Appl. No.: 18/843,006

(22) PCT Filed: Jun. 8, 2023

(86) PCT No.: PCT/CN2023/099132

§ 371 (c)(1),
(2) Date: Aug. 30, 2024

(87) PCT Pub. No.: WO2024/055645

PCT Pub. Date: Mar. 21, 2024

(65) Prior Publication Data

US 2025/0198097 A1 Jun. 19, 2025

(30) Foreign Application Priority Data

Sep. 13, 2022 (CN) ..... 202211108764.3

(51) Int. Cl.
*E01D 19/06* (2006.01)

(52) U.S. Cl.
CPC ..... *E01D 19/065* (2013.01)

(58) Field of Classification Search
CPC ..... E01D 19/065; E01D 19/06; E01D 19/125; E01D 21/00
See application file for complete search history.

(56) References Cited

U.S. PATENT DOCUMENTS 6,460,214 B1 * 10/2002 Chang ..... E01D 19/06 14/73.1
10,563,360 B2 * 2/2020 Bang ..... E01D 19/06
(Continued)

*Primary Examiner* — Tara Schimpf
(74) *Attorney, Agent, or Firm* — Wang Law Firm, Inc.

(57) ABSTRACT

A bridge expansion and contraction device comprises a gap crossing plate disposed in a first mounting recess and a fixed plate dispose in a second mounting recess. One or more height adjustment assemblies, lower support base assemblies, a rotating shaft assembly and upper pressing assemblies are disposed in the first mounting recess. Each lower support base assembly is connected to one corresponding height adjustment assembly, the rotating shaft assembly is supported on the lower support base assemblies, each upper pressing assembly is connected to the one corresponding height adjustment assembly and located above the aforementioned lower support base assembly and presses the rotating shaft assembly. In a process of mounting, the flatness between the expansion and contraction device and the bridge floor is adjusted, and the device can be mounted quickly without bolts. The present invention further discloses an installation method of the bridge expansion and contraction device.

25 Claims, 10 Drawing Sheets

(56) References Cited

U.S. PATENT DOCUMENTS

2003/0115815 A1* 6/2003 Azizinamini ..... E01D 19/125
404/71
2007/0044257 A1* 3/2007 Xu ..... E01D 19/06
14/73.1

* cited by examiner

BRIDGE EXPANSION AND CONTRACTION DEVICE AND INSTALLATION METHOD THEREFOR

TECHNICAL FIELD OF THE INVENTION

The present invention relates to a field of bridge expansion and contraction devices, and in particular to a bridge expansion and contraction device and an installation method therefor.

BACKGROUND OF THE INVENTION

The creep of bridges resulted from vehicle load, bridge material and temperature during their operation, wind force action and other factors cause bridge shrinkage and stretching deformation. Expansion and contraction devices, as one of important functional members of bridges, are usually mounted between different beams and between a beam and an abutment, in order to deal with bridge deformation. In order to ensure safe and smooth running of vehicles, the expansion and contraction devices mounted on the bridges have to meet the variability of the bridge beams. The conventional comb-plate-formed expansion and contraction joints are complicated and difficult in their site adjustment and mounting although they can meet the expansion and contraction, displacement and other requirements of the bridge beams. Moreover, the comb plates of the existing expansion and contraction devices are all connected by bolts, so that a plurality of bolt holes formed on the plate surfaces leads to high noise when vehicles run. Furthermore, it is difficult to adjust the flatness between the expansion and contraction devices and the bridge floor. In conclusion, it is necessary to improve the existing bridge expansion and contraction devices, and also the existing installation methods of bridge expansion and contraction devices.

SUMMARY OF THE INVENTION

It is a first object of the present invention to provide a bridge expansion and contraction device which is adjustable in its height when the device is mounted at a bridge construction site and can be mounted without any bolt.

It is a second object of the present invention to provide a convenient and quick installation method for the bridge expansion and contraction device when the device is mounted at a bridge construction site.

For achieving the first object, the bridge expansion and contraction device, which is disposed between an end of a first beam and an end of a second beam, comprise a gap crossing plate connected to the first beam and crossing over a gap between the first beam and the second beam; a fixed plate being engaged with the gap crossing plate and connected to the second beam; one or more height adjustment assemblies; one or more lower support base assemblies; a rotating shaft assembly; and one or more upper pressing assemblies; wherein, the first beam has a first mounting recess at the end of the first beam for receiving the gap crossing plate, the second beam has a second mounting recess at the end of the second beam for receiving the fixed plate; the one or more height adjustment assemblies, the one or more lower support base assemblies, the rotating shaft assembly and the one or more upper pressing assemblies are disposed in the first mounting recess; each height adjustment assembly is disposed inside the first mounting recess, each lower support base assembly is connected to one corresponding height adjustment assembly, the rotating shaft assembly extending along a width of the bridge is supported on the one or more lower support base assemblies, each upper pressing assembly is connected to the one corresponding height adjustment assembly and located above the aforementioned lower support base assembly and presses the rotating shaft assembly. Thus, the gap crossing plate and the fixed plate can be installed without any bolt.

Preferably, each lower support base assembly has a plurality of lower positioning holes each extending vertically, and each upper pressing assembly has a plurality of upper positioning through holes each extending vertically and corresponding to one of the plurality of lower positioning holes; a detachable adjustment fastener passes downward through each upper positioning through hole and each corresponding lower positioning hole, so as to adjust a mounting position of each lower support base assembly, each upper pressing assembly and the gap crossing plate.

The lower support base assembly and the upper support base assembly each can be designed in various structures. Preferably, each lower support base assembly comprises a rib plate and a lower support base disposed on and supported by the rib plate, each upper pressing assembly comprises a L-shaped buckling plate having a top transverse portion and a side vertical portion, the rotating shaft assembly comprises a rotating shaft connected to the bottom of the gap crossing plate and located on the lower support base; the top transverse portion of the buckling plate is buckled on the lower support base and presses the rotating shaft tightly together with the lower support base, and the side vertical portion of the buckling plate is connected to the corresponding height adjustment assembly; the plurality of lower positioning holes is located on the lower support base, and the plurality of upper positioning holes is located on the top transverse portion of the buckling plate.

Preferably, the buckling plate comprises a first snap plate, a second snap plate and a top press plate located between the first snap plate and the second snap plate for pressing the rotating shaft, the rotating shaft assembly further comprises an elastic press plate disposed between the top press plate and the rotating shaft. The elastic press plate is usually an elastic rubber plate. When the top press plate presses the rotating shaft, the rotating shaft is pressed by the deformation of the rubber plate, so that the gap crossing plate can rotate, through the rotating shaft, relative to the lower support base assembly and the upper pressing assembly.

Preferably, the buckling plate is a one-piece member, the rotating shaft assembly further comprises an elastic press plate disposed between the top transverse portion of the buckling plate and the rotating shaft. Similarly, with an arrangement of the elastic press plate, it is convenient for the gap crossing plate to rotate, through the rotating shaft, relative to the lower support base assembly and the upper pressing assembly.

The height adjustment assembly can be designed in various structures. Each height adjustment assembly is a height adjustment plate which is located at the side of the support rib, the lower support base and the buckling plate; each height adjustment plate has a step portion adjacent to the buckling plate to support the buckling plate; the support rib and the lower support base are connected to the height adjustment plate and the side vertical portion of the buckling plate by a connecting piece. In this way, the height of the buckling plate can be adjusted directly through the height adjustment plate, and the height of the lower support base assembly can be adjusted indirectly by connecting members, so that the gap crossing plate can be adjusted to reach a desired flatness.

To fix the height adjustment assembly on a bottom of the first mounting recess, a first embedded steel sheet is mounted on the bottom of the first mounting recess, and a bottom of each height adjustment assembly is connected to the first embedded steel sheet by welding.

The height adjustment assembly can be designed in other structures. Preferably, each height adjustment assembly is an L-shaped connecting plate, and the lower support base assembly and the upper pressing assembly are connected to the L-shaped connecting plate by welding.

To realize transverse rotation and vertical turning of the expansion and contraction device, a plurality of elastic fastening assemblies is connected to a bottom of the gap crossing plate, the one or more lower support base assemblies are located at a root of the gap crossing plate and the plurality of elastic fastening assemblies is located away from the root of the gap crossing plate; a bottom of each elastic fastening assembly is connected to a bottom of the first mounting recess or connected to the corresponding lower support base assembly.

Preferably, each elastic fastening assembly comprises a box having a bottom, a bolt having a top and an elastic sleeve; the bottom of the box is connected to the bottom of the first mounting recess, the bolt is disposed inside the box with the top of the bolt extending upward from the box to connect to the bottom of the gap crossing plate, and the elastic sleeve surrounding the bolt is disposed inside the box. Under such a design, the elastic fastening assembly is capable of turning transversely or vertically in some extents. The elastic sleeve may be made of various elastic materials such as spring, rubber, spring diaphragm and spring wire.

Preferably, each elastic fastening assembly comprises an clastic main body, an upper connecting reinforcing bar, a lower connecting reinforcing bar and a threaded end; the threaded end is disposed at a top of the elastic fastening assembly to connect to the bottom of the gap crossing plate, the first mounting recess is filled with concrete, the upper connecting reinforcing bar is positioned and embedded in the concrete, and the lower connecting reinforcing bar is connected to the lower support base assembly.

A bumper baffle is connected to an outer side of the height adjustment assembly so that a concrete-free structure can be ensured. The bumper baffle may be a steel plate, and may be adjusted in height according to the actual mounting size requirement.

Preferably, both the gap crossing plate and the fixed plate have matching comb teeth which engage with each other.

The fixed plate can be disposed in various ways. Preferably, the second mounting recess has a bottom, a second embedded steel sheet is disposed on the bottom of the second mounting recess, and the fixed plate is connected to the second embedded steel sheet through a plurality of support racks.

The support rack can be designed in various structures. Preferably, each support rack comprises two support plates in a saddle shape and an upper support plate atop the support plates, the support plates are disposed at regular intervals along a width of the bridge, a stainless steel sliding plate is disposed on the upper support plate, and the fixed plate rests on the stainless steel sliding plate.

Preferably, each support plate is arranged along the width of the bridge, correspondingly, each upper support plate is arranged along a length of the bridge.

To make the mounting structure of the support rack firmer, preferably, each upper support plate has a plurality of reinforcing bar via holes.

Preferably, the plurality of support plates is disposed in two lines arranged along the length of the bridge, each upper support plate is supported between two corresponding support plates of different lines.

To limit the fixed plate in the direction of the length of the bridge, preferably, a limit plate which limits the fixed plate in the direction of the length of the bridge is disposed adjacent to an outer side of an outer line of the support plates.

Preferably, each support plate is arranged along a length of the bridge, correspondingly, each upper support plate is arranged along the width of the bridge.

To make the mounting structure of the support rack firmer, preferably, each upper support plate has a plurality of reinforcing bar via holes.

As another solution for the fixation of the fixed plate, the second mounting recess has a bottom, a plurality of shear studs is disposed on the bottom of the second mounting recess, and the fixed plate is fastened on the shear studs through a plurality of anchor assemblies.

For achieving the second object, the installation method of the bridge expansion and contraction device comprises:

S1) integrally digging and cleaning the mounting recesses for receiving the bridge expansion and contraction device, and measuring a depth of each mounting recess;

S2) according to the depth of the mounting recesses measured in the step S1, correspondingly processing one or more height adjustment assemblies of the bridge expansion and contraction device, welding the height adjustment assemblies onto the first embedded steel sheet, and cleaning slags and welds;

S3) mounting the fixed plate, and adjusting flatness between the fixed plate and the bridge floor;

S4) mounting the gap crossing plate, adjusting flatness between the gap crossing plate and the fixed plate to meet the requirement of a desired flatness, mounting the lower support base assemblies, the rotating shaft assembly and the upper pressing assemblies, adjusting the position of each lower support base assembly and the corresponding upper pressing assembly to be connected to the corresponding height adjustment assembly; and S5) pouring concrete in the first mounting recess and the second mounting recess and curing to complete the mounting of the bridge expansion and contraction device.

To realize a concrete-free structure, preferably, after the step S4 and before the step S5, a bumper baffle is connected to the outer side of the height adjustment assembly by welding, and a top surface of the bumper baffle is flush with a bridge floor.

Preferably, before the step S5, the slags and welds are completely cleaned to ensure that the mounting recesses are clean.

Preferably, in the step S4, adjustment bolts are used as the adjustment fasteners, and the upper positioning holes and the lower positioning holes are bolt holes; firstly, the lower support base assemblies, the upper pressing assemblies and the gap crossing plate are adjusted to a proper position and then fastened by the adjustment bolts; then, each lower support base assembly and the corresponding upper pressing assembly are fastened to the corresponding height adjustment assembly by welding; and finally, the adjustment bolts are removed, and the bolt holes are plug-welded or sealed by elastic glue.

Preferably, in the step S4, using a top surface of the gap crossing plate as a baseline, a top of the upper pressing assembly is leveled with the top surface of the gap crossing plate by tooling, and each lower support base assembly is connected to the corresponding upper pressing assembly by welding; and then, each upper pressing assembly is fastened to the corresponding height adjustment assembly by welding.

Compared with the prior art, the bridge expansion and contraction device of the present invention has following advantages: the bridge expansion and contraction device can be mounted without bolts at a bridge construction site, thus the loosening connection between bolts and nuts is eliminated, and a noise produced by running of vehicles is reduced since there is no bolt hole on the surface of the beams; the gap crossing plate is mounted through an elastic connection among the lower support base assembly, the rotating shaft assembly and the upper pressing assembly, accordingly, the gap crossing plate is prevented from falling-off and a function of a transverse turning and a vertical turning of the gap crossing plate can be achieved. In a process of mounting at a bridge construction site, the flatness between the expansion and contraction device and the bridge floor can be adjusted according to the depth of the recess through the adjustment of the height of the height adjustment assembly, the bridge expansion and contraction device is welded to the embedded steel sheet in the recess directly, reducing intermediate steps, so that the bridge expansion and contraction device can be mounted quickly.

DETAILED DESCRIPTION OF THE INVENTION

Figure 1:
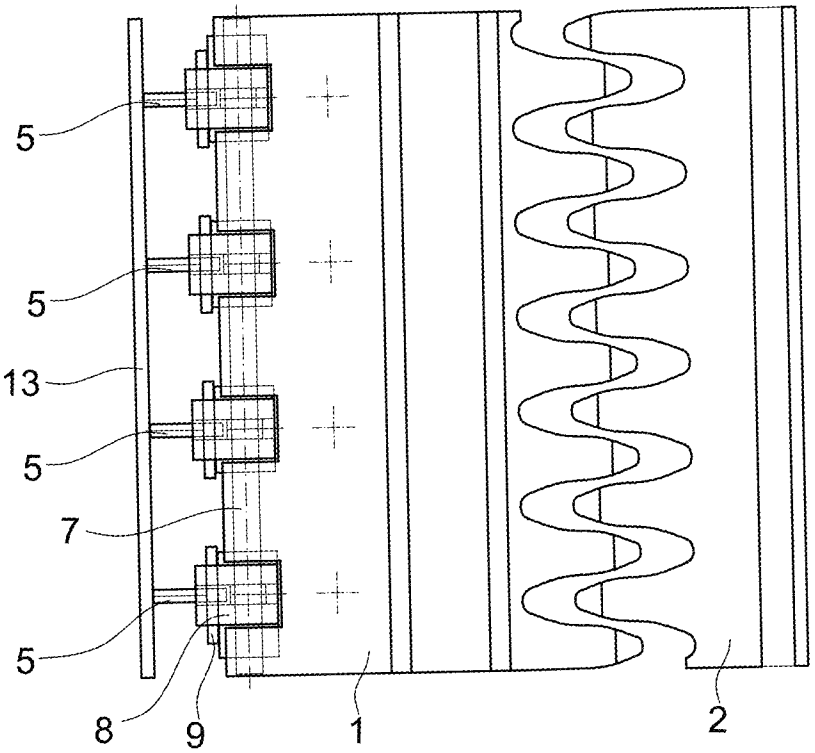
FIG. 1 is a plan view of a bridge expansion and contraction device according to Embodiment 1 of the present invention.

The present invention will be further described below in detail by embodiments with reference to the accompanying drawings.

Embodiment 1

FIGS. 1-8 show a preferred Embodiment 1 of a bridge expansion and contraction device of the present invention. The bridge expansion and contraction device comprises a gap crossing plate 1 and a fixed plate 2 being engaged with the gap crossing plate 1. Both the gap crossing plate 1 and the fixed plate 2 have matching comb teeth which engage with each other and respectively arranged at intervals at an opposite end of the gap crossing plate 1 and the fixed plate 2. The first beam has a first mounting recess 31 at the end 3 of the first beam for receiving the gap crossing plate 1, the second beam has a second mounting recess 41 at the end 4 of the second beam for receiving the fixed plate 2.

One or more height adjustment assemblies 5, one or more lower support base assemblies 6, the rotating shaft assembly 7 and one or more upper pressing assemblies 8 are disposed in the first mounting recess 31. Each height adjustment assembly 5 is connected to the end 3 of the first beam inside the first mounting recess 31. Specifically, the first mounting recess 31 has a bottom, a first embedded steel sheet 11 is mounted on the bottom of the first mounting recess 31, a bottom of each height adjustment assembly 5 is connected to the first embedded steel sheet 11 by welding. Each height adjustment assembly 5 in this embodiment is a height adjustment plate 51 having a step portion 511.

Figure 3:
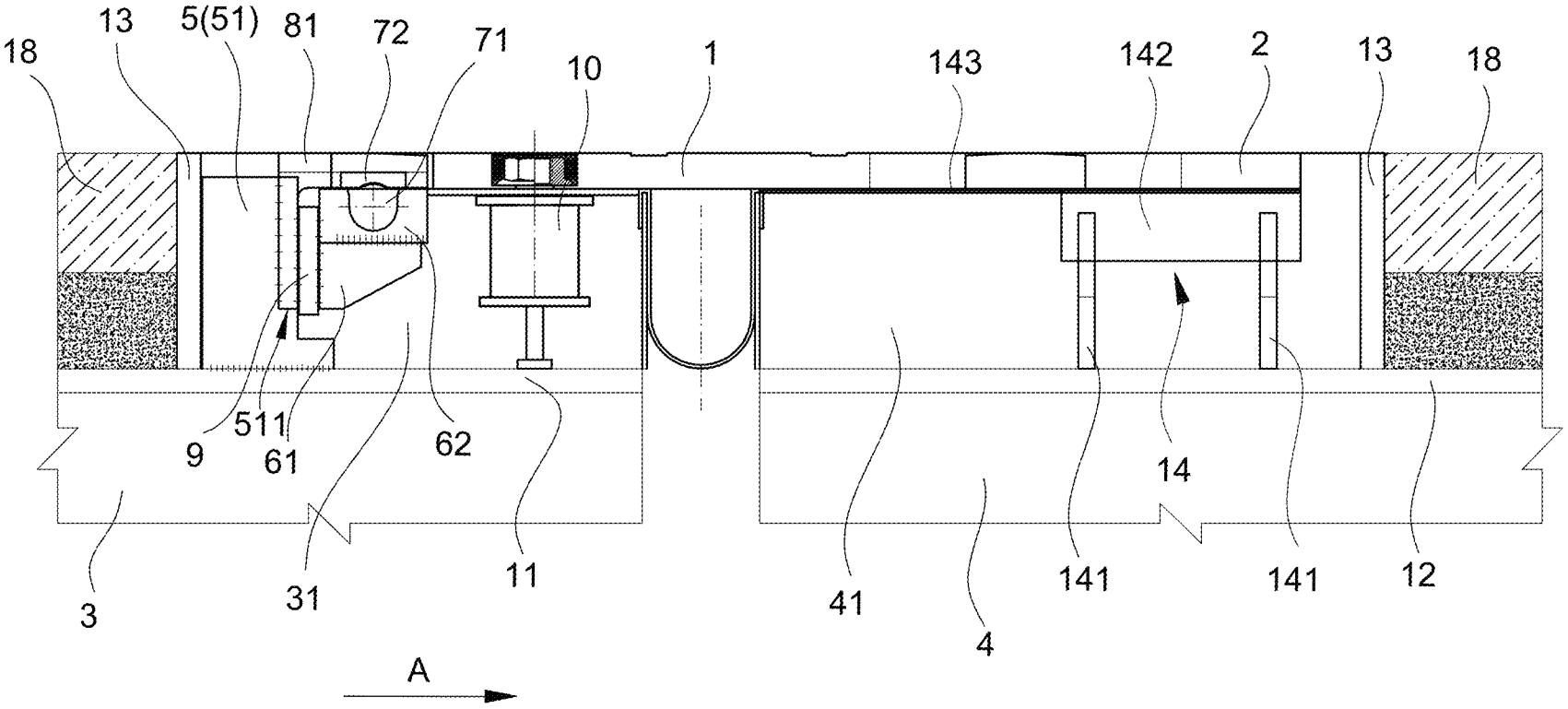
FIG. 3 is a sectional view of the bridge expansion and contraction device according to Embodiment 1 of the present invention.
Figure 8:
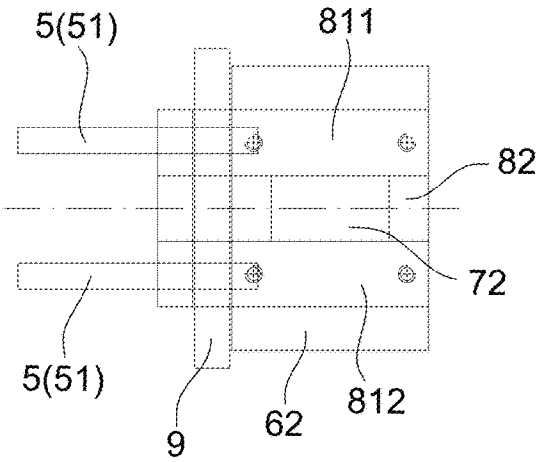
FIG. 8 is a top plan view of the FIG. 7.
Figure 7:
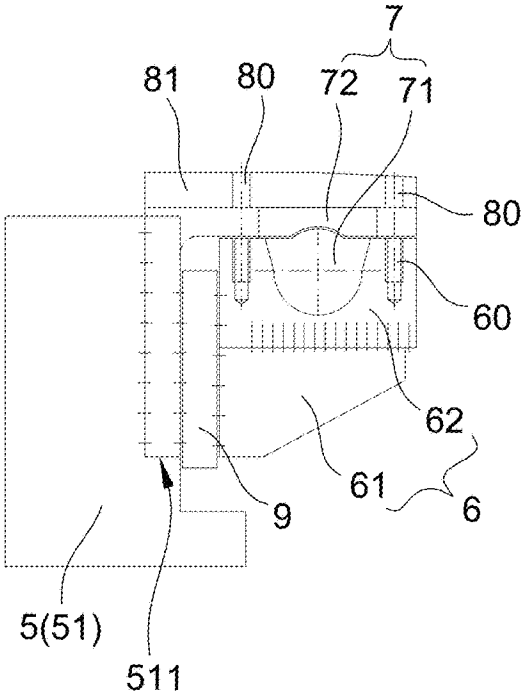
FIG. 7 is a sectional view of a part of the bridge expansion and contraction device according to Embodiment 1 of the present invention.

Considering a direction indicated by the arrow A in FIG. 3 as an inward direction (a direction of inner side), the lower support base assembly 6 is arranged on an inner side of the height adjustment plate 51. Each lower support base assembly 6 in this embodiment comprises a rib plate 61 and a lower support base 62 disposed on and supported by the rib plate 61. The rib plate 61 is a triangular rib plate, and each lower support base assembly 6 has a plurality of lower positioning holes 60 each extending vertically. Each upper pressing assembly 8 comprises a L-shaped buckling plate 81 having a top transverse portion and a side vertical portion. The step portion 511 support the buckling plate 81 so that a height of the buckling plate 81 can be adjusted by the height adjustment plate 51. As shown in FIG. 8, the buckling plate 81 in this embodiment is a split member. That is, the buckling plate 81 comprises a first snap plate 811, a second snap plate 812 and a top press plate 82 located between the first snap plate 811 and the second snap plate 812. Both the first snap plate 811 and the second snap plate 812 are steel sheets. The top press plate 82 made of clastic material compresses a rotating shaft 71 on the gap crossing plate 1. Meanwhile, due to its elasticity, the gap crossing plate 1 is capable of rotating under certain stress, to meet the vertical turning requirement of the bridge. The first snap plate 811, the second snap plate 812 and the top press plate 82 may be made into one piece. The first snap plate 811, the second snap plate 812 have a plurality of lower positioning holes 60 each extending vertically on a top of the first snap plate 811, the second snap plate 812. A detachable adjustment fastener passes downward through each upper positioning through hole 80 and each corresponding lower positioning hole 60, so as to adjust a mounting position of each lower support base assembly 6, each upper pressing assembly 8 and the gap crossing plate 1. In this embodiment, adjustment bolts (which are not shown in Figs) are used as the adjustment fasteners, and the upper positioning holes and the lower positioning holes are bolt holes. The lower support base assemblies 6, the upper pressing assemblies 8 and the gap crossing plate 1 are adjusted to a proper position and then fastened by the adjustment bolts.

The rotating shaft assembly 7 in this embodiment comprises a rotating shaft 71 and an clastic press plate 72. The rotating shaft 71 extends along a width of the bridge and is connected to the bottom of the gap crossing plate 1. The clastic press plate 72, an clastic rubber plate, is compressed between the top press plate 82 and the rotating shaft 71. The rotating shaft 71 is compressed by a deformation of the rubber plate 72, so that the gap crossing plate 1 is fastened and is capable of rotating, through the rotating shaft 71, relative to the lower support base assembly 6 and the upper pressing assembly 8. That is, the bridge expansion and contraction device is capable of turning vertically through the rotating shaft 71. When the mounting is completed, the top transverse portion of the buckling plate 81 is buckled on the lower support base 62 and presses the rotating shaft 71 tightly together with the lower support base 62; the support rib 61 and the lower support base 62 are connected to the height adjustment plate 51 and the side vertical portion of the buckling plate 81 through welding to a connecting piece 9. The buckling plate 81 can be connected to the height adjustment plate 51 by welding.

In addition, the buckling plate 81 can be a one-piece member. The elastic press plate 72 is compressed between the rotating shaft and the buckling plate 81.

Figure 5:
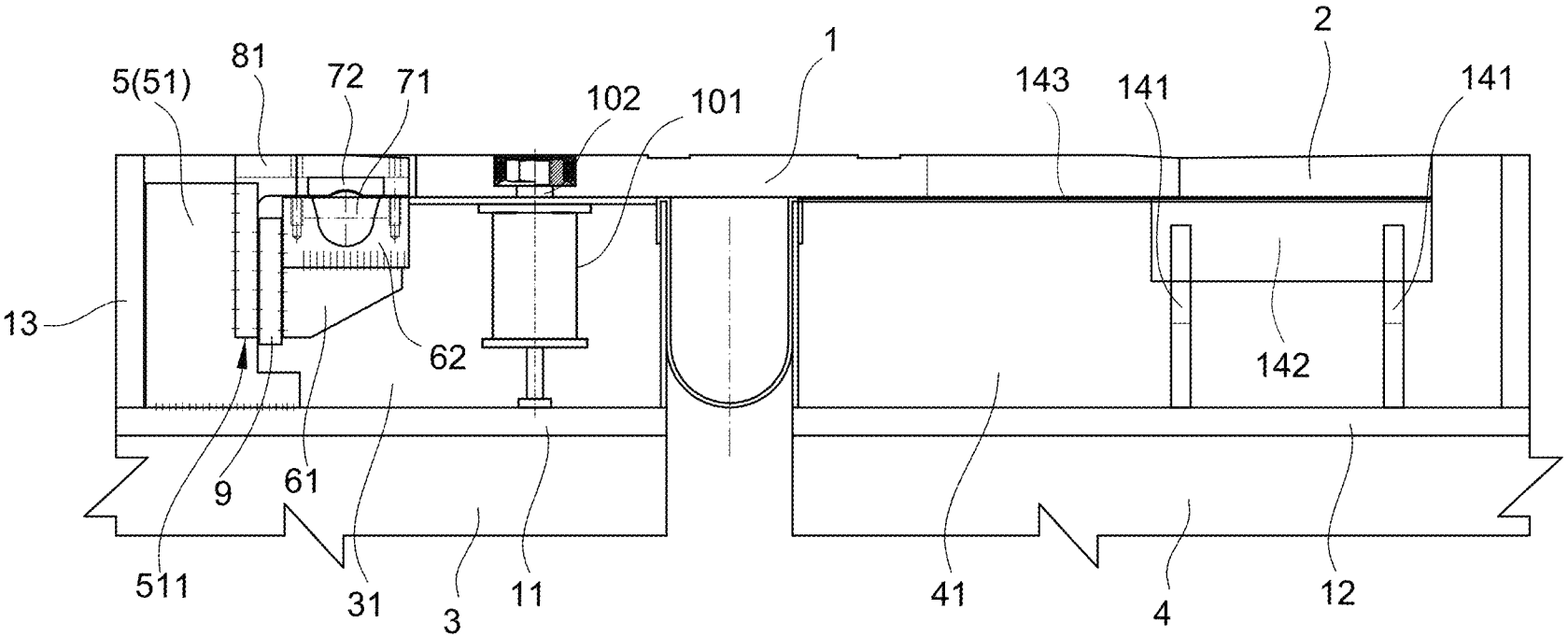
FIG. 5 is another sectional view of the bridge expansion and contraction device according to Embodiment 1 of the present invention.
Figure 6:
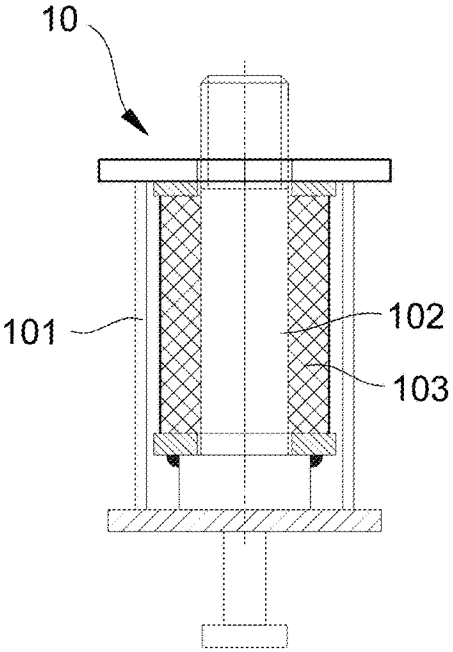
FIG. 6 is a sectional view of an elastic fastening assembly according to Embodiment 1 of the present invention.
Figure 9:
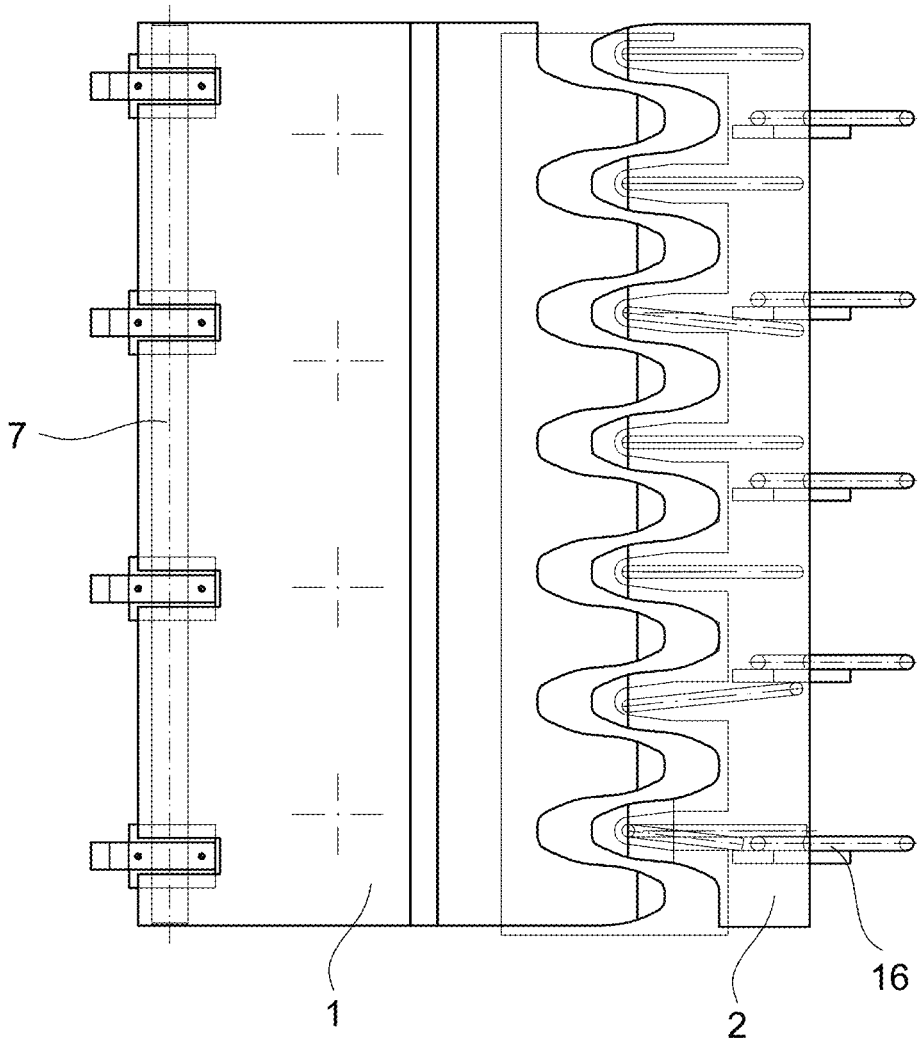
FIG. 9 is a plan view of a bridge expansion and contraction device according to Embodiment 2 of the present invention.
Figure 10:
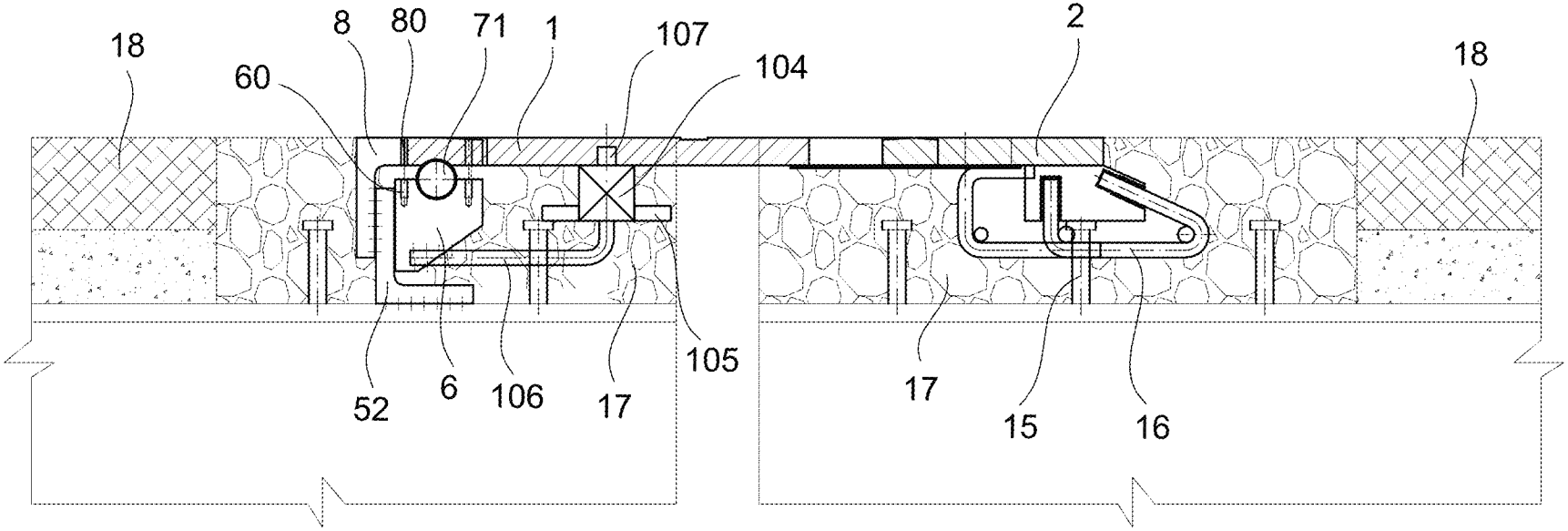
FIG. 10 is a sectional view of the bridge expansion and contraction device according to Embodiment 2 of the present invention.
Figure 13:
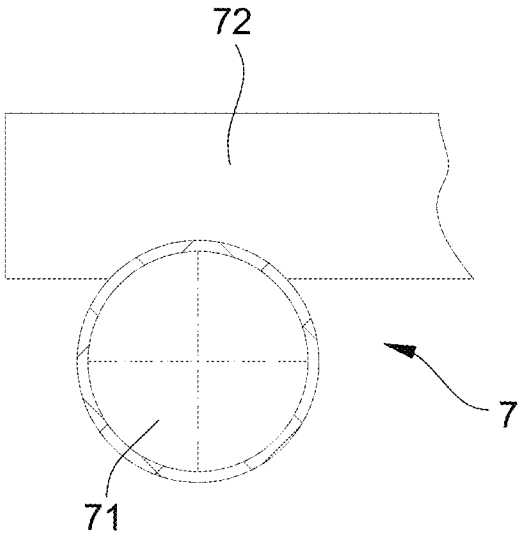
FIG. 13 is a sectional view of a rotating shaft assembly according to Embodiment 2 of the present invention.
Figure 12:
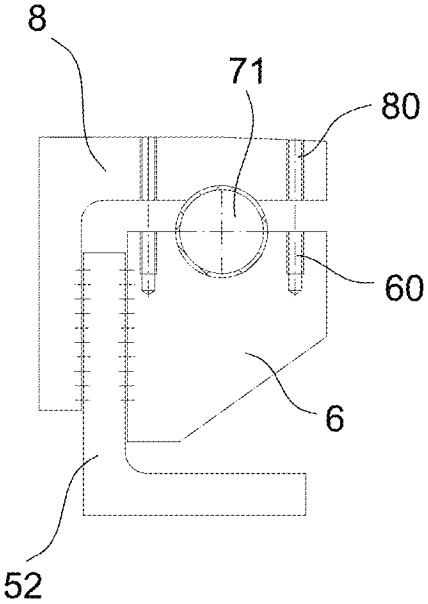
FIG. 12 is a sectional view of a part of the bridge expansion and contraction device according to Embodiment 2 of the present invention.
Figure 11:
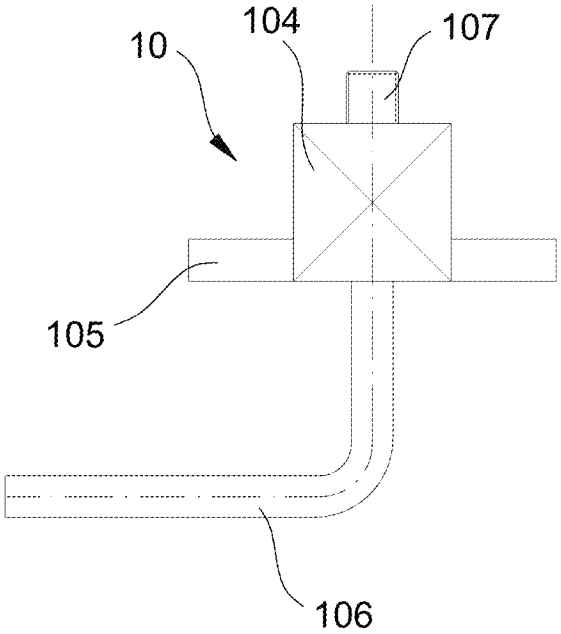
FIG. 11 is a plan view of an elastic fastening assembly according to Embodiment 2 of the present invention.

As shown in FIG. 3, FIG. 5 and FIG. 6, a plurality of elastic fastening assemblies 10 is connected to a bottom of the gap crossing plate 1, the one or more lower support base assemblies 6 are located at a root of the gap crossing plate 1 and the plurality of elastic fastening assemblies 10 is located away from the root of the gap crossing plate 1; a bottom of each elastic fastening assembly 10 is connected to a first embedded steel sheet 11 mounted on the bottom of the first mounting recess 31. Each elastic fastening assembly 10 comprises a box 101 having a bottom, a bolt 102 having a top and an elastic sleeve 103. The bottom of the box 101 is connected to the bottom of the first mounting recess 31, the bolt 102 is disposed inside the box 101 with the top of the bolt 102 extending upward from the box 101 to connect to the bottom of the gap crossing plate 1, and the elastic sleeve 103 surrounding the bolt 102 is disposed inside the box 101. The box 101, made of steel sheets, protects the elastic sleeve 103. Each elastic fastening assembly 10 is capable of turning transversely and vertically in some extents. The elastic sleeve may be made of various clastic materials such as spring, rubber, spring diaphragm and spring wire.

Figure 2:
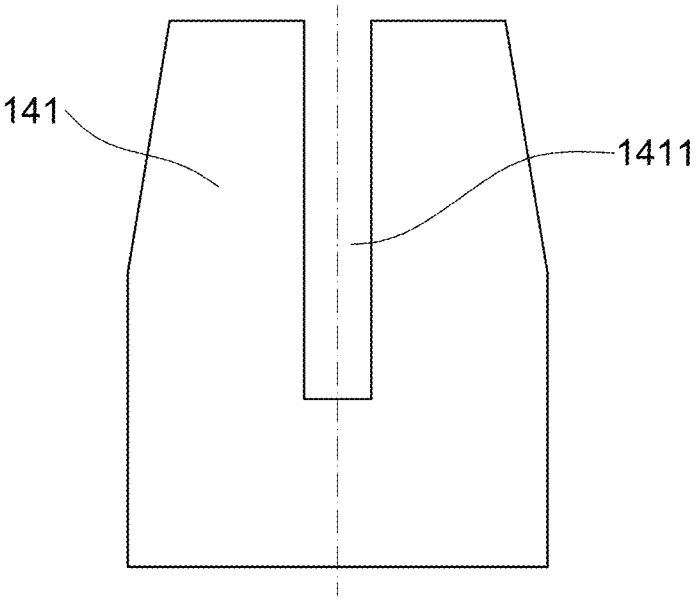
FIG. 2 is a plan view of a support plate in a saddle shape according to Embodiment 1 of the present invention.

As shown in FIGS. 2-3, the second mounting recess 41 has a bottom, a second embedded steel sheet 12 is disposed on the bottom of the second mounting recess 41, and the fixed plate 2 is connected to the second embedded steel sheet 12 through a plurality of support racks 14.

In this embodiment, each support rack 14 comprises two support plates 141 in a saddle shape and an upper support plate 142 atop the support plates 141. A bottom of each support plate 141 is welded onto the second embedded steel sheet 12. The support plates 141 are disposed at regular intervals along the width of the bridge and disposed in two lines arranged along the length of the bridge, each upper support plate 142 is supported between two corresponding support plates 141 of different lines. In this embodiment, each support plate 141 is arranged along the width of the bridge, each upper support plate 142 is arranged along a length of the bridge. The support plate 141 has a chute 1411 in a middle of the support plate 141 for receiving the upper support plate 142. The flatness between the fixed plate 2 and the bridge floor is adjusted by the chute 1411. A stainless steel sliding plate 143 is disposed on the upper support plate 142 and the fixed plate 2 rests on the stainless steel sliding plate 143.

The bridge expansion and contraction device in this embodiment is a concrete-free structure, and a bumper baffle 13 is connected to an outer side of the height adjustment plate 51. The bumper baffle 13 may be a steel plate, and may be adjusted in height according to an actual mounting size requirement. As shown in FIG. 3, a bridge floor pavement layer 18 is arranged on the outer side of the bumper baffle 13. Top surfaces of the gap crossing plate 1, the fixed plate 2 and the bumper baffle 13 are flush with a top surface of the bridge floor pavement layer 18. The bridge floor pavement layer 18 may be made of various pavement materials, for example, pitch, concrete, epoxy resin, etc.

Figure 4:
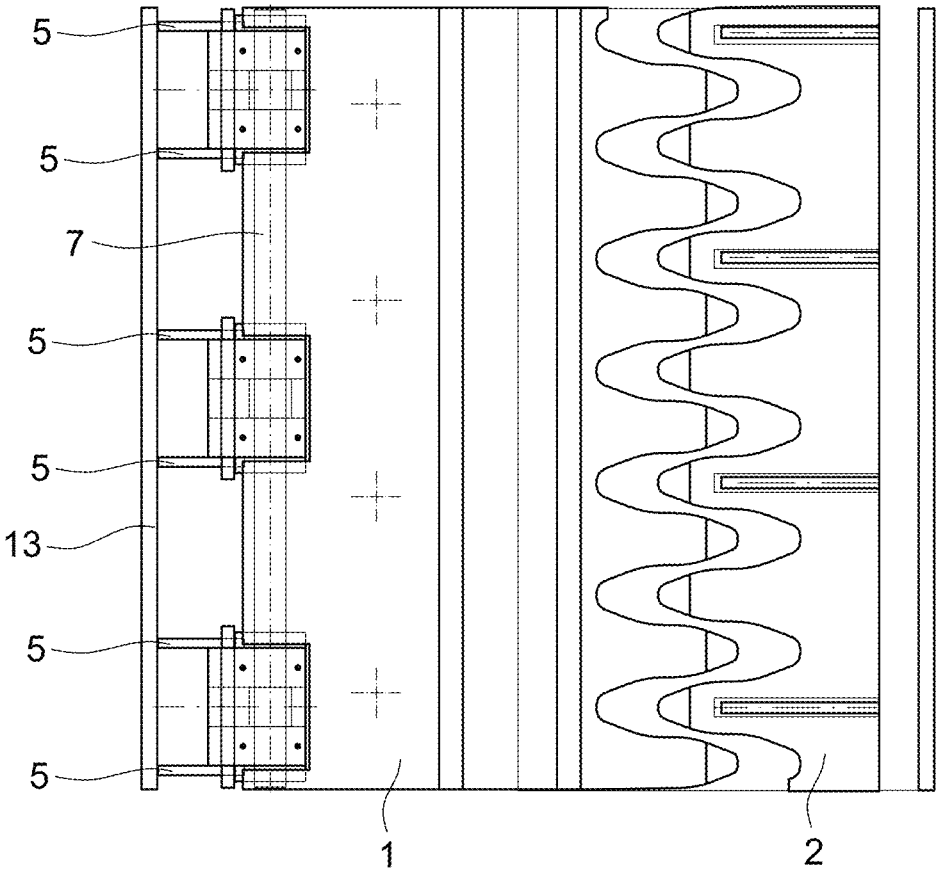
FIG. 4 is another plan view of the bridge expansion and contraction device with three groups of support assemblies on one gap crossing plate according to Embodiment 1 of the present invention during mounting.

In addition, considering the height adjustment assembly 5, the corresponding lower support base assembly 6 and upper pressing assembly 8 as a group of support assemblies. As shown in FIG. 1, four groups of support assemblies are arranged at an outer end, i.e., the root, of the gap crossing plate 1. As shown in FIG. 4, three groups of support assemblies are arranged at the outer end, i.e., the root, of the gap crossing plate 1. The number of groups of support assemblies can be determined according to different width of the gap crossing plate 1.

When the bridge has a horizontally transverse movement, the bridge expansion and contraction device is capable of rotating transversely due to an elastic deformation produced by the clastic fastening assemblies 10 in a front and the elastic press plate 72 and also due to a gap between the comb teeth of the gap crossing plate 1 and the fixed plate 2. When the bridge has a vertical movement, the bridge expansion and contraction device is capable of rotating vertically due to a rotation of the rotating shaft assembly 7 compressed by the upper pressing component 8.

The installation process of the bridge expansion and contraction device in this embodiment comprises: digging of recesses for receiving the expansion and contraction device, cleaning of the recesses, detection of embedded steel sheets in the recesses, mounting of the elastic support assemblies, mounting of a part of the bridge expansion and contraction device which is disposed inside the recesses, mounting of the rest components of the bridge expansion and contraction device, pouring of the elastic assemblies, and completing the mounting of the whole bridge expansion and contraction device.

Specifically, the installation method comprises:

S1) integrally digging and cleaning the mounting recesses for receiving the bridge expansion and contraction device, and measuring a depth of each mounting recess;

S2) according to the depth of the mounting recesses measured in the step S1, correspondingly processing one or more height adjustment assemblies 5 of the bridge expansion and contraction device, welding the height adjustment assemblies 5 onto the first embedded steel sheet 11, and cleaning slags and welds;

S3) mounting the fixed plate 2, and adjusting flatness between the fixed plate 2 and the bridge floor;

S4) mounting the gap crossing plate 1, adjusting flatness between the gap crossing plate 1 and the fixed plate 2 to meet the requirement of a desired flatness, mounting the lower support base assemblies 6, the rotating shaft assembly 7 and the upper pressing assemblies 8, adjusting the position of each lower support base assembly 6 and the corresponding upper pressing assembly 8 to be connected to the corresponding height adjustment assembly 5 by welding; and S5) pouring concrete in the first mounting recess 31 and the second mounting recess 41 and curing to complete the mounting of the bridge expansion and contraction device.

In the step S2, a bottom of each support plate 141 is welded onto the second embedded steel sheet 12, and the top of the support plate 141 is connected to the fixed plate 2 by welding. The flatness between the fixed plate 2 and the bridge floor is adjusted by the chute 1411 on the top of the support plate 141.

In this embodiment, between the step S4 and the step S5, another two steps may be added in the step S4 and the step S5: (a) connecting a bumper baffle 13 to the outer side of the height adjustment assembly 5 by welding so that a top surface of the bumper baffle 13 is flush with a bridge floor; and (b) cleaning slags and welds completely to ensure that the mounting recesses are clean.

In addition, in the step S4, adjustment bolts are used as the adjustment fasteners, and the upper positioning holes and the lower positioning holes are bolt holes. Firstly, the lower support base assemblies 6, the upper pressing assemblies 8 and the gap crossing plate 1 are adjusted to a proper position and then fastened by the adjustment bolts; then, each lower support base assembly 6 and the corresponding upper pressing assembly 8 are fastened to the corresponding height adjustment assembly 5 by welding; and finally, the adjustment bolts are removed, and the bolt holes are plug-welded or sealed by elastic glue. Alternatively, using a top surface of the gap crossing plate 1 as a baseline, a top of the upper pressing assembly 8 is leveled with the top surface of the gap crossing plate 1 by tooling, and each lower support base assembly 6 is connected to the corresponding upper pressing assembly 8 by welding; and then, each upper pressing assembly 8 is fastened to the corresponding height adjustment assembly 5 by welding. In conclusion, in addition to transverse displacement, a function of a transverse turning and a vertical turning of the gap crossing plate can be achieved. By using the multidirectional-displacement bridge expansion and contraction device which can be fastened by buckling instead of bolts, the bridge expansion and contraction device can be mounted without bolts at a bridge construction site, thus the loosening connection between bolts and nuts is eliminated, and a noise produced by the running of vehicles is reduced since there is no bolt hole on the plate surface of the beams. Accordingly, the gap crossing plate is prevented from falling-off.

Embodiment 2

FIGS. 9-13 show a preferred Embodiment 2 of the bridge expansion and contraction device of the present invention. The bridge expansion and contraction device in this embodiment is a concrete structure. Each height adjustment plate 5 in this embodiment is an L-shaped connecting plate 52, the lower support base assembly 6 and the upper pressing assembly 8 are connected to the L-shaped connecting plate 52 by welding. Each elastic fastening assembly 10 comprises an elastic main body 104, an upper connecting reinforcing bar 105, a lower connecting reinforcing bar 106 and a threaded end 107. The threaded end 107 is disposed at a top of the clastic fastening assembly 10 to connect to the bottom of the gap crossing plate 1, the first mounting recess 31 is filled with concrete 17, the upper connecting reinforcing bar 105 is positioned and embedded in the concrete 17, and the lower connecting reinforcing bar 106 is connected to the lower support base assembly 6. In this embodiment, the second mounting recess 41 has a bottom, a plurality of shear studs 15 is disposed on the bottom of the second mounting recess 41, and the fixed plate 2 is fastened on the shear studs 15 through a plurality of anchor assemblies 16. The remaining structure of this embodiment is the same as that of the Embodiment 1, and will not be further described here.

Embodiment 3

Figure 14:
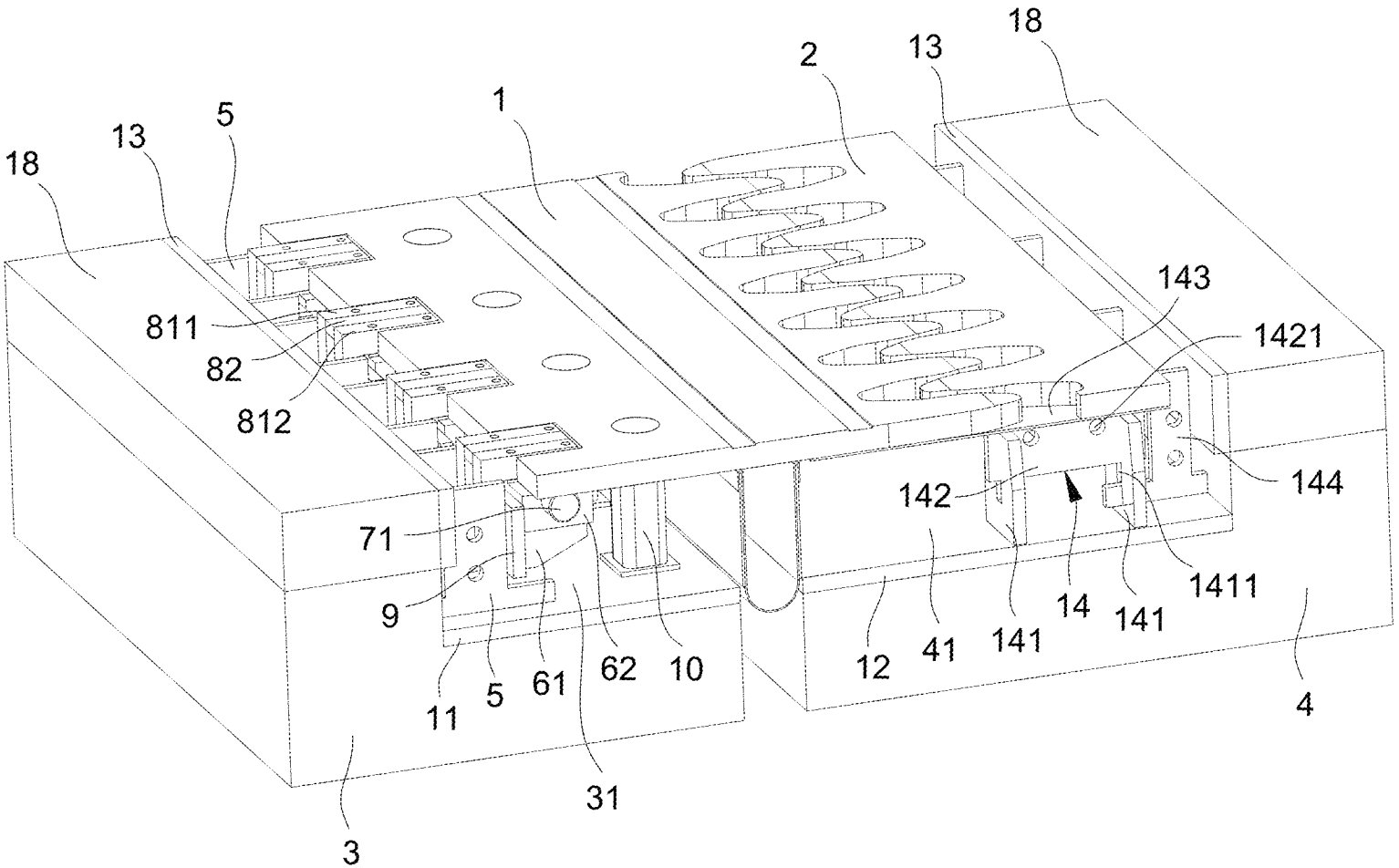
FIG. 14 is a perspective view of a bridge expansion and contraction device according to Embodiment 3 of the present invention.

As shown in FIG. 14, in the bridge expansion and contraction device in this embodiment, each upper support plate 142 has a plurality of reinforcing bar via holes 1421. During mounting, the reinforcing bars pass through the reinforcing bar via holes 1421 so as to enhance a structural strength of the bridge expansion and contraction device. In this embodiment, a limit plate 144 which limits the fixed plate 2 in the direction of the length of the bridge is disposed adjacent to an outer side of an outer line of the support plates 141. The limit plate 144 has a plurality of reinforcing bar via holes. The remaining structure of this embodiment is the same as that of the Embodiment 1, and will not be further described here.

Embodiment 4

Figure 15:
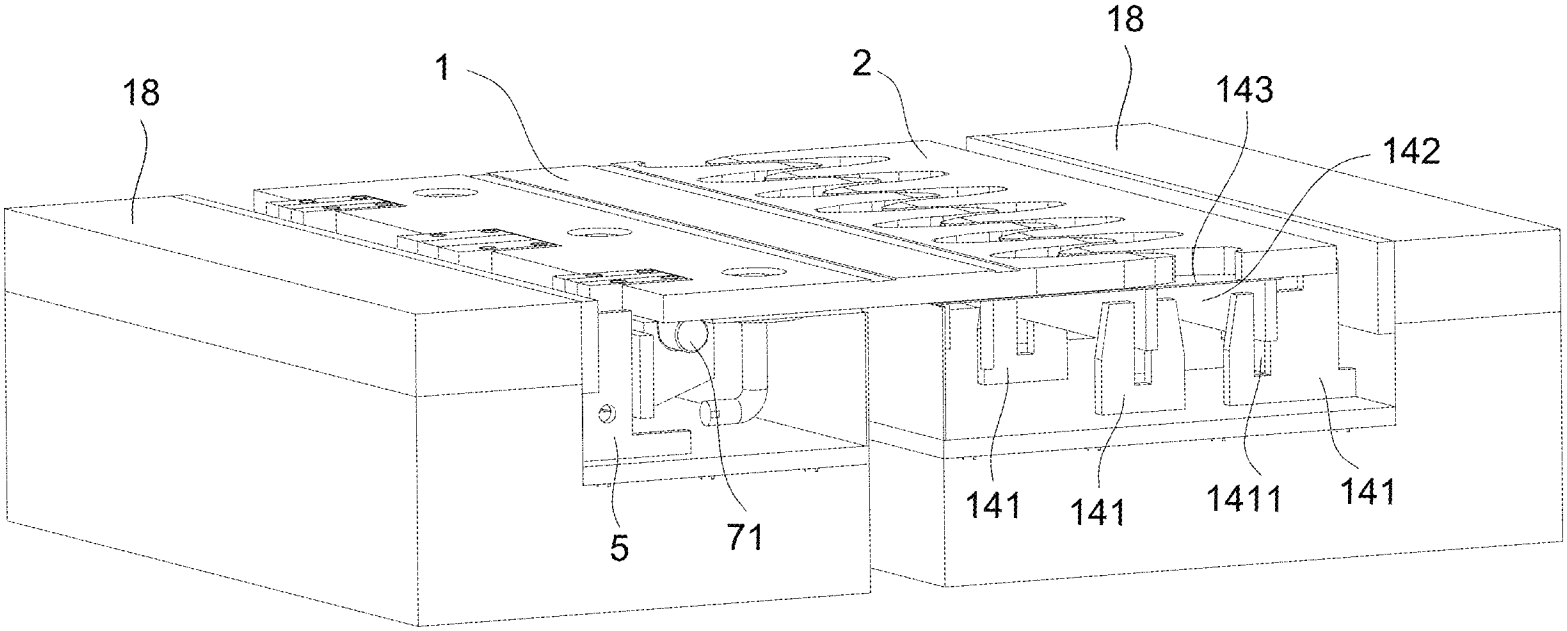
FIG. 15 is a perspective view of a bridge expansion and contraction device according to Embodiment 4 of the present invention.

As shown in FIG. 15, in the bridge expansion and contraction device in this embodiment, each support plate 141 is arranged along a length of the bridge, correspondingly, each upper support plate 142 is arranged along the width of the bridge. The plurality of support plates 141 is disposed in two lines arranged along the length of the bridge, and the upper support plate 142 connects the support plates 141 arranged in a same column. To improve the structural strength of the bridge expansion and contraction device, each support plate 141 has a plurality of reinforcing bar via holes 1421. The elastic fastening assembly 10 in this embodiment may have the same structure as that in Embodiment 1, or the same structure as that in Embodiment 2, or other structures. The remaining structure of this embodiment is the same as that of Embodiment 1, and will not be further described here.

The invention claimed is:

1. A bridge expansion and contraction device, which is disposed between an end (3) of a first beam and an end (4) of a second beam, comprising:

a gap crossing plate (1) connected to the first beam and crossing over a gap between the first beam and the second beam;

a fixed plate (2) being engaged with the gap crossing plate (1) and connected to the second beam;

one or more height adjustment assemblies (5);

one or more lower support base assemblies (6);

a rotating shaft assembly (7); and one or more upper pressing assemblies (8);

wherein, the first beam has a first mounting recess (31) at the end (3) of the first beam for receiving the gap crossing plate (1), the second beam has a second mounting recess (41) at the end (4) of the second beam for receiving the fixed plate (2);

the one or more height adjustment assemblies (5), the one or more lower support base assemblies (6), the rotating shaft assembly (7) and the one or more upper pressing assemblies (8) are disposed in the first mounting recess (31);

each height adjustment assembly (5) is disposed inside the first mounting recess (31), each lower support base assembly (6) is connected to one corresponding height adjustment assembly (5), the rotating shaft assembly (7) extending along a width of the bridge is supported on the one or more lower support base assemblies (6), each upper pressing assembly (8) is connected to the one corresponding height adjustment assembly (5) and located above the aforementioned lower support base assembly (6) and presses the rotating shaft assembly (7);

each lower support base assembly (6) has a plurality of lower positioning holes (60) each extending vertically, and each upper pressing assembly (8) has a plurality of upper positioning through holes (80) each extending vertically and corresponding to one of the plurality of lower positioning holes (60); a detachable adjustment fastener passes downward through each upper positioning through hole (80) and each corresponding lower positioning hole (60), so as to adjust a mounting position of each lower support base assembly (6), each upper pressing assembly (8) and the gap crossing plate (1);

each lower support base assembly (6) comprises a rib plate (61) and a lower support base (62) disposed on and supported by the rib plate (61), each upper pressing assembly (8) comprises a L-shaped buckling plate (81) having a top transverse portion and a side vertical portion, the rotating shaft assembly (7) comprises a rotating shaft (71) connected to the bottom of the gap crossing plate (1) and located on the lower support base (62);

the top transverse portion of the buckling plate (81) is buckled on the lower support base (62) and presses the rotating shaft (71) tightly together with the lower support base (62), and the side vertical portion of the buckling plate (81) is connected to the corresponding height adjustment assembly (5);

the plurality of lower positioning holes (60) is located on the lower support base (62), and the plurality of upper positioning holes (80) is located on the top transverse portion of the buckling plate (81).

2. The bridge expansion and contraction device of claim 1, wherein the buckling plate (81) comprises a first snap plate (811), a second snap plate (812) and a top press plate (82) located between the first snap plate (811) and the second snap plate (812) for pressing the rotating shaft (71), the rotating shaft assembly (7) further comprises an elastic press plate (72) disposed between the top press plate (82) and the rotating shaft (71).

3. The bridge expansion and contraction device of claim 1, wherein the buckling plate (81) is a one-piece member, the rotating shaft assembly (7) further comprises an elastic press plate (72) disposed between the top transverse portion of the buckling plate (81) and the rotating shaft (71).

4. The bridge expansion and contraction device of claim 1, wherein each height adjustment assembly (5) is a height adjustment plate (51) which is located at the side of the support rib (61), the lower support base (62) and the buckling plate (81);

each height adjustment plate (51) has a step portion (511) adjacent to the buckling plate (81) to support the buckling plate (81);

the support rib (61) and the lower support base (62) are connected to the height adjustment plate (51) and the side vertical portion of the buckling plate (81) by a connecting piece (9).

5. The bridge expansion and contraction device of claim 1, wherein each height adjustment assembly (5) is an L-shaped connecting plate (52), the lower support base assembly (6) and the upper pressing assembly (8) are connected to the L-shaped connecting plate (52) by welding.

6. The bridge expansion and contraction device of claim 1, wherein a plurality of elastic fastening assemblies (10) is connected to a bottom of the gap crossing plate (1), the one or more lower support base assemblies (6) are located at a root of the gap crossing plate (1) and the plurality of elastic fastening assemblies (10) is located away from the root of the gap crossing plate (1);

a bottom of each elastic fastening assembly (10) is connected to a bottom of the first mounting recess (31) or connected to the corresponding lower support base assembly (6).

7. The bridge expansion and contraction device of claim 6, wherein each elastic fastening assembly (10) comprises a box (101) having a bottom, a bolt (102) having a top and an elastic sleeve (103);

the bottom of the box (101) is connected to the bottom of the first mounting recess (31), the bolt (102) is disposed inside the box (101) with the top of the bolt (102) extending upward from the box (101) to connect to the bottom of the gap crossing plate (1), and the elastic sleeve (103) surrounding the bolt (102) is disposed inside the box (101).

8. The bridge expansion and contraction device of claim 6, wherein each elastic fastening assembly (10) comprises an elastic main body (104), an upper connecting reinforcing bar (105), a lower connecting reinforcing bar (106) and a threaded end (107);

the threaded end (107) is disposed at a top of the elastic fastening assembly (10) to connect to the bottom of the gap crossing plate (1), the first mounting recess (31) is filled with concrete (17), the upper connecting reinforcing bar (105) is positioned and embedded in the concrete (17), and the lower connecting reinforcing bar (106) is connected to the lower support base assembly (6).

9. The bridge expansion and contraction device of claim 1, wherein a bumper baffle (13) is connected to an outer side of the height adjustment assembly (5).

10. The bridge expansion and contraction device of claim 1, wherein both the gap crossing plate (1) and the fixed plate (2) have matching comb teeth which engage with each other.

11. The bridge expansion and contraction device of claim 1, wherein the second mounting recess (41) has a bottom, a second embedded steel sheet (12) is disposed on the bottom of the second mounting recess (41), and the fixed plate (2) is connected to the second embedded steel sheet (12) through a plurality of support racks (14).

12. The bridge expansion and contraction device of claim 11, wherein each support rack (14) comprises two support plates (141) in a saddle shape and an upper support plate (142) atop the support plates (141), the support plates (141) are disposed at regular intervals along a width of the bridge, a stainless steel sliding plate (143) is disposed on the upper support plate (142), and the fixed plate (2) rests on the stainless steel sliding plate (143).

13. The bridge expansion and contraction device of claim 12, wherein each support plate (141) is arranged along the width of the bridge, correspondingly, each upper support plate (142) is arranged along a length of the bridge.

14. The bridge expansion and contraction device of claim 13, wherein each upper support plate (142) has a plurality of reinforcing bar via holes (1421).

15. The bridge expansion and contraction device of claim 13, wherein the plurality of support plates (141) is disposed in two lines arranged along the length of the bridge, each upper support plate (142) is supported between two corresponding support plates (141) of different lines.

16. The bridge expansion and contraction device of claim 15, wherein a limit plate (144) which limits the fixed plate (2) in the direction of the length of the bridge is disposed adjacent to an outer side of an outer line of the support plates (141).

17. The bridge expansion and contraction device of claim 12, wherein each support plate (141) is arranged along a length of the bridge, correspondingly, each upper support plate (142) is arranged along the width of the bridge.

18. The bridge expansion and contraction device of claim 17, wherein each upper support plate (142) has a plurality of reinforcing bar via holes (1421).

19. The bridge expansion and contraction device of claim 1, wherein the second mounting recess (41) has a bottom, a plurality of shear studs (15) is disposed on the bottom of the second mounting recess (41), and the fixed plate (2) is fastened on the shear studs (15) through a plurality of anchor assemblies (16).

20. The bridge expansion and contraction device of claim 1, wherein the first mounting recess (31) has a bottom, a first embedded steel sheet (11) is mounted on the bottom of the first mounting recess (31), a bottom of each height adjustment assembly (5) is connected to the first embedded steel sheet (11) by welding.

21. An installation method of the bridge expansion and contraction device of claim 20, comprising:

S1) integrally digging and cleaning the mounting recesses for receiving the bridge expansion and contraction device, and measuring a depth of each mounting recess;

S2) according to the depth of the mounting recesses measured in the step S1, correspondingly processing one or more height adjustment assemblies (5) of the bridge expansion and contraction device, welding the height adjustment assemblies (5) onto the first embedded steel sheet (11), and cleaning slags and welds;

S3) mounting the fixed plate (2), and adjusting flatness between the fixed plate (2) and the bridge floor;

S4) mounting the gap crossing plate (1), adjusting flatness between the gap crossing plate (1) and the fixed plate (2) to meet the requirement of a desired flatness, mounting the lower support base assemblies (6), the rotating shaft assembly (7) and the upper pressing assemblies (8), adjusting the position of each lower support base assembly (6) and the corresponding upper pressing assembly (8) to be connected to the corresponding height adjustment assembly (5); and S5) pouring concrete in the first mounting recess (31) and the second mounting recess (41) and curing to complete the mounting of the bridge expansion and contraction device.

22. The installation method of claim 21, wherein after the step S4 and before the step S5, a bumper baffle (13) is connected to the outer side of the height adjustment assembly (5) by welding, and a top surface of the bumper baffle (13) is flush with a bridge floor.

23. The installation method of claim 21, wherein before the step S5, the slags and welds are completely cleaned to ensure that the mounting recesses are clean.

24. The installation method of claim 21, wherein in the step S4, adjustment bolts are used as the adjustment fasteners, and the upper positioning holes and the lower positioning holes are bolt holes;

firstly, the lower support base assemblies (6), the upper pressing assemblies (8) and the gap crossing plate (1) are adjusted to a proper position and then fastened by the adjustment bolts; then, each lower support base assembly (6) and the corresponding upper pressing assembly (8) are fastened to the corresponding height adjustment assembly (5) by welding; and finally, the adjustment bolts are removed, and the bolt holes are plug-welded or sealed by elastic glue.

25. The installation method of claim 21, wherein in the step S4, using a top surface of the gap crossing plate (1) as a baseline, a top of the upper pressing assembly (8) is leveled with the top surface of the gap crossing plate (1) by tooling, and each lower support base assembly (6) is connected to the corresponding upper pressing assembly (8) by welding; and then, each upper pressing assembly (8) is fastened to the corresponding height adjustment assembly (5) by welding.

* * * * *